United States Patent [19]

Wittenberg et al.

[11] Patent Number: 4,559,021

[45] Date of Patent: Dec. 17, 1985

[54] POSEABLE DOLL HEAD

[75] Inventors: Mark S. Wittenberg, Anaheim; Virgil W. Wulff, Fullerton, both of Calif.

[73] Assignee: Mattel, Inc., Hawthorne, Calif.

[21] Appl. No.: 565,507

[22] Filed: Dec. 27, 1983

[51] Int. Cl.[4] ..... A63H 11/00

[52] U.S. Cl. ..... 446/352; 446/359

[58] Field of Search ..... 446/330, 338, 352, 359, 446/319, 391, 394, 296, 331, 339, 340

[56] References Cited

U.S. PATENT DOCUMENTS

| | | | |
|---|---|---|---|
| 2,968,104 | 1/1961 | Ito | 35/59 |
| 3,135,444 | 6/1964 | Schoenfeld | 223/66 |
| 3,147,566 | 9/1964 | Ong | 446/359 |
| 3,184,886 | 5/1965 | Weih | 46/118 |
| 3,464,150 | 9/1969 | Troy | 446/394 |
| 3,465,474 | 9/1969 | Gardel et al. | 46/164 |
| 3,775,900 | 12/1973 | Thorns et al. | 446/354 |
| 4,071,249 | 1/1978 | Goldfarb et al. | 446/330 |
| 4,217,726 | 8/1980 | Flicker et al. | 446/330 X |

*Primary Examiner*—Mickey Yu

*Attorney, Agent, or Firm*—Ron Goldman; Mel Klein

[57] ABSTRACT

A mechanically actuable doll's head (12) is mounted on an angled cut (20) formed in a neck (14) and is supported on a pair of shoulders (16) fixed to a supporting base (18). An actuating mechanism (26) for rotating the head from one side to the other, and at the same time tilting the head up or down is provided, and includes a knob (28), a first shaft (32), a first bevel gear (34), a second bevel gear (38), a second shaft (42) and a neck-plug (44) having an enlarged portion (46) carrying the head.

1 Claim, 7 Drawing Figures

10
12
14
16
18
20
26
28
30
32
34
36
38
40
42
44
46
5
6
5
6

POSEABLE DOLL HEAD

TECHNICAL FIELD

This invention relates to doll heads and more particularly to a doll head moveable by actuating means held in a base supporting the same.

BACKGROUND ART

Dolls, mannequins and toys are known in which a head is moveable by various means which are connected directly or indirectly to the head. One such device is set forth in U.S. Pat. No. 2,968,104. This patent discloses a model human head provided with hairs held within the head by means of an adhesive mixed with material in the head. The model head is moveable about ball and socket or hinged plate mounting means so that the head may be moved into position whereby the hair of the head may be dressed or make-up applied to the face of the head.

U.S. Pat. No. 3,135,444 discloses a mannequin with an adjustable head. The head includes an elongated neck member extending into the shoulders of the mannequin whereby the head is moveable relative to the shoulders of the mannequin and may be universally tilted in any desired direction.

U.S. Pat. No. 3,184,886 discloses a doll having a combined sound and motion mechanism contained with the body of the doll. The head is moveably mounted on the doll body for relative complex motion by means of an angularly off-set shaft extension coupled to a sleeve held in the head. Rotation and flexion are imparted to the head in response to rotation of the shaft.

U.S. Pat. No. 3,465,474 discloses a bobbing head doll in which the head is universally mounted on the doll's body. A conterbalancing weight is connected to the outer end of an elongated shaft rigidly secured to the head and depending into the body. The doll's head moves by action of the weight, when the doll is moved.

All of the foregoing patents, relate to means for moving a doll or mannequin head in various ways. However, none of these patents disclose the unique means of moving the doll's head of the present invention, including an actuating means connected to gearing means within a base supporting the moveable head, and further including a specifically shaped neck on which the head is supported for movement to different angles.

BEST MODE FOR CARRYING OUT THE INVENTION

Figure 1:
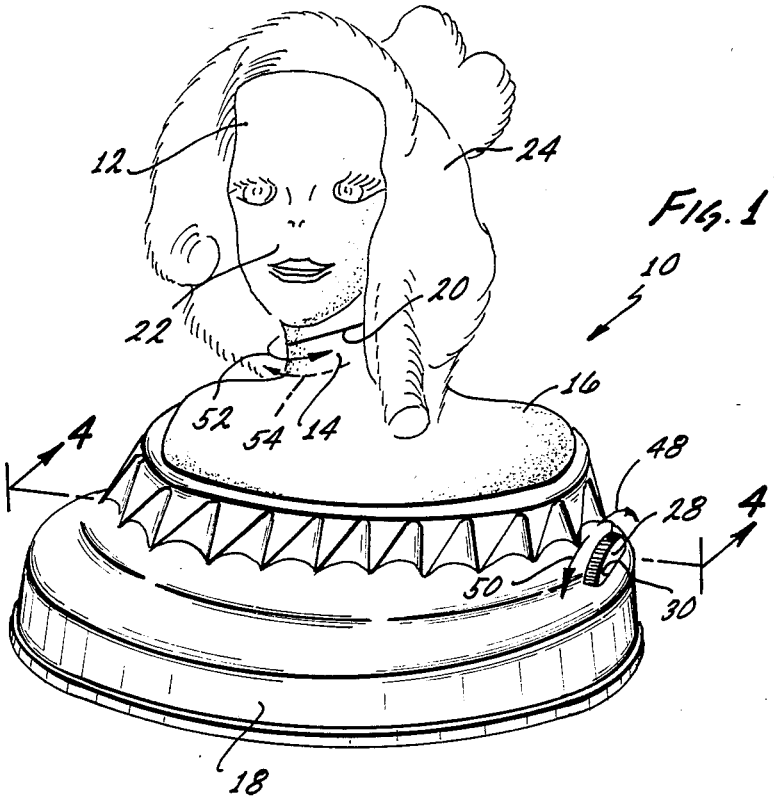
FIG. 1 is a perspective view of a preferred embodiment of a poseable doll's head and supporting base of the present invention.

A preferred embodiment of the invention is illustrated in the drawings, wherein like reference numerals throughout the several views refer to like elements.

Figure 2:
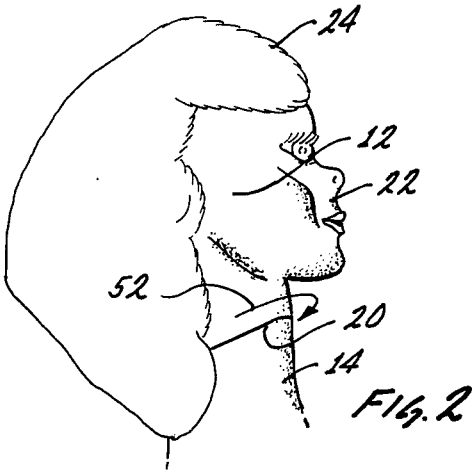
FIG. 2 is a perspective view of the doll's head of FIG. 1, with the face looking upward after having been turned in the direction of the clockwise indicating arrow.
Figure 3:
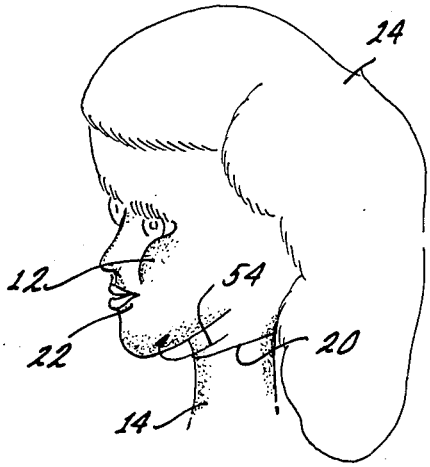
FIG. 3 is a perspective view of the doll's head of FIG. 1, with the face looking downward, after having been turned in the direction of the clockwise indicating arrow.
Figure 4:
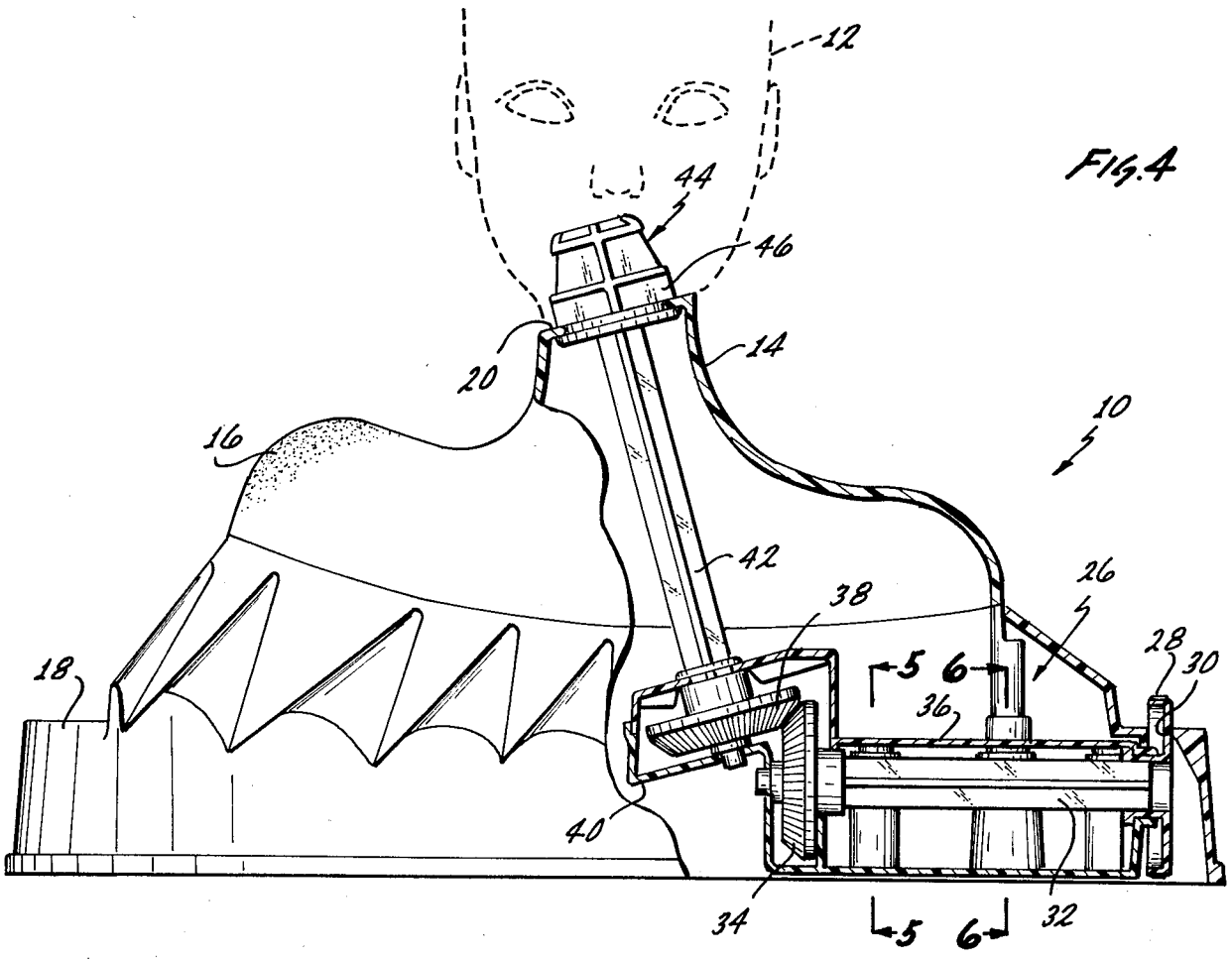
FIG. 4 is an enlarged partial front elevational view, of the doll's head and supporting base of FIG. 1, with a section broken away along line 4—4, showing the details of a preferred actuating mechanism.
Figure 5:
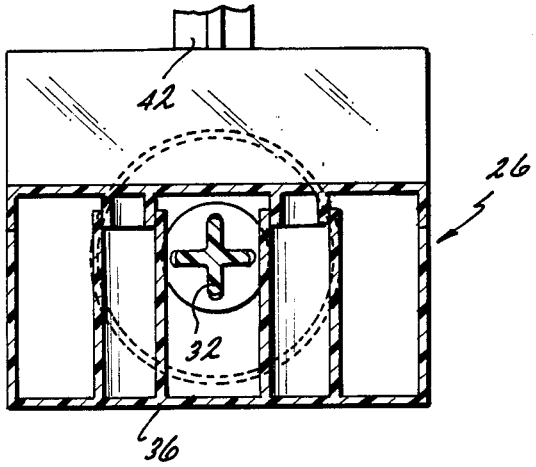
FIG. 5 is a partial sectional view taken along line 5—5 of FIG. 4.
Figure 6:
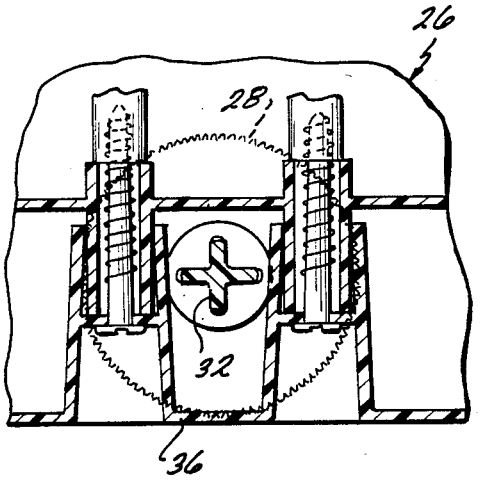
FIG. 6 is a partial sectional view taken along line 6—6 of FIG. 4.
Figure 7:
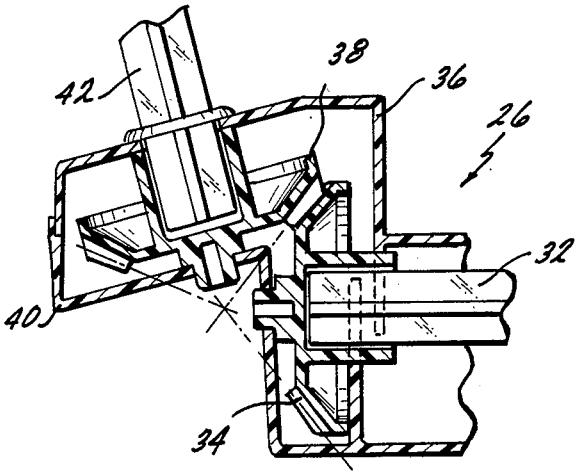
FIG. 7 is an enlarged partial sectional view of the bevel gears shown in FIG. 4.

As shown in FIGS. 1–3 the preferred embodiment comprises a stand 10 having a head 12, mounted on a neck 14, supported by shoulders 16 held in a base 18. The head 12 includes a face 22, and has hair 24 fixed thereto in any convenient manner. The neck is separated or divided in two, along an angled or slanted cut 20, whereby, the head may be turned, in either the clockwise or counterclockwise directions, about the cut, with respect to the lower portion of the neck, the shoulders 16 and base 18. The division or separation of the neck in two, along the angled cut 20 allows the face 22 of the head 12 to be moved up or down, that is, it appears to be looking up or down, with respect to the base 18, depending on the direction of rotation of the head. In this manner, a child playing with the head may use the head as it wishes, such as, more easily applying makeup to the face 22, when the head is rotated so that the face is looking upward (FIG. 2), toward the child. Alternatively, when the head is rotated so that the face is looking downward (FIG. 3), toward the base, a child playing with the head may more easily work with or play with the hair 24 fixed to the head.

As shown more clearly in FIGS. 4–7, the actuating mechanism 26 for operating or rotating the head 12 includes a knob 28, which may be knurled for ease in operation by a child. The knob 28 partially extends outwardly through an opening 30 formed in the base 18, but is substantially held internally of the base. The knob is keyed or held to the end of a shaft 32, which may be any desired shape, but which is shown as being substantially "X" shaped. The end of shaft 32, opposite the end held to knob 28, carries a first bevel gear 34 fixed thereto. Shaft 32 is rotatably held, as by journal means, within a housing 36, secured to or held within base 18, by any convenient means, such as screws, substantially parallel to the bottom of base 18, or to any flat surface, such as a desk or table, on which the stand 10 may be placed.

A further or second bevel gear 38, mates with first bevel gear 34 at an oblique angle, less than 90 degrees, and is held or supported within an extended section 40 of housing 36. Bevel gear 38 is fixed to or held on one end of a second shaft 42, also shown as being "X" shaped, which extends upwardly from the base at an obtuse angle, through the interior of the shoulders 16. The other or second end of the second shaft 42 is fixed or held in a collar or neck plug 44, rotatably held within neck 14, at cut 20, and extending into and firmly holding the upper portion of the neck, and therefore the head 12 on an enlarged portion 46, for rotation of the head with the neck plug.

OPERATION

In use, a child may play with the poseable head in any desired manner, such as, to apply make-up to the face, or to dress or set the hair attached to the head. This is more easily accomplished, and allows the child to more readily see what it is doing, or admire its handiwork, by rotating the head. This rotation is accomplished by rotating the knob, as by using the thumb. The knob is rotatable in either the clockwise or counterclockwise direction, and rotates the head, at the neck, about cut 20 in the same direction. That is, if the knob 28 is rotated in the clockwise direction, i.e., arrow 48, FIG. 1, the head 12 will also be rotated in the clockwise direction, (arrow 52, FIGS. 1 and 2). If knob 28 is rotated in the counterclockwise direction (arrow 50, FIG.1) the head 12 will also be rotated in the counterclockwise direction, (arrow 54, FIGS. 1 and 3). This is accomplished through the direct drive arrangement of knob 28, shaft 32, bevel gears 34, 38 and shaft 42, connected to neck plug 44 on which head 12 is firmly mounted.

As seen more clearly in FIGS. 2 and 3, due to the slanted or angled cut 20 in neck 14, when head 12 is rotated in the clockwise direction (arrow 52) the face 12 will look, or be pointed up (FIG. 2). However, if head 12 is rotated in the counterclockwise direction (arrow 54) the face 12 will look, or be pointed down (FIG. 3).

It therefore can be seen that an easy to use and manipulate doll's head, moveable about a supporting base to allow a child to play with the same, as by applying make-up or dressing the hair on the head, has been provided. The head may easily be turned in either direction, by the thumb or hand of a child using the same. This frees the other hand of the child to use as the child sees fit while the head is being moved, or when the head has been moved to the appropriate position.

While the particular poseable doll's head of the present invention has been described in considerable detail, it is to be understood that this description is merely illustrative of the invention and that no limitations are intended other than as found in the attached claims.

We claim:

1. An improved stand supporting a poseable doll's head for dressing by a young child, said stand comprising:

a base having a bottom flat surface adapted to stand on a further flat surface;

a pair of shoulders supported on said base;

a neck supported on said shoulders; and a doll's head having a face and hair permanently affixed to said head around said face moveably mounted on said neck at an angle formed by a cut through said neck, said head being movable about said cut by the action of an actuating means held within said base; said actuating means extending from said base and coupled to a neck plug held within said head at said cut for selected movement of said head, said actuating means being mounted within a housing held internally of said base, and including an operating knob rotatable on a horizontal axis and extending partially out of an opening formed in said base; said operating knob being fixed to one end of a first shaft disposed on a horizontal axis, with the other end of said first shaft connected to a first bevel gear, supported within an extension to said housing, said first bevel gear coacting with a second bevel gear held in said extension to said housing at an obtuse angle, and a second shaft connected at one end to said second bevel gear, with the other end of said second shaft coupled to said neck plug and rotatably carried at said cut through said neck, whereby said head may be moved by a young child to a predetermined position by rotating said operating knob with a single finger to cause the head to turn about said angled cut, to look up or down with said respect to said base while the child focuses attention on the head and uses the other hand to dress the head.

* * * * *